US010790104B2

(12) United States Patent
Okada

(10) Patent No.: US 10,790,104 B2
(45) Date of Patent: Sep. 29, 2020

(54) ROTARY SWITCH DEVICE

(71) Applicant: ALPHA CORPORATION, Yokohama-shi, Kanagawa (JP)

(72) Inventor: Takahiro Okada, Yokohama (JP)

(73) Assignee: ALPHA CORPORATION, Yokohama-shi, Kanagawa (JP)

( * ) Notice: Subject to any disclaimer, the term of this patent is extended or adjusted under 35 U.S.C. 154(b) by 0 days.

(21) Appl. No.: 16/176,149

(22) Filed: Oct. 31, 2018

(65) Prior Publication Data

US 2019/0066948 A1 Feb. 28, 2019

Related U.S. Application Data

(63) Continuation of application No. PCT/JP2017/018385, filed on May 16, 2017.

(30) Foreign Application Priority Data

May 17, 2016 (JP) ..... 2016-099040

(51) Int. Cl.
*H01H 19/08* (2006.01)
*H01H 19/14* (2006.01)
(Continued)

(52) U.S. Cl.
CPC ..... *H01H 19/14* (2013.01); *H01H 19/02* (2013.01); *H01H 19/08* (2013.01); *H01H 27/06* (2013.01); *H01H 2235/01* (2013.01)

(58) Field of Classification Search
CPC ..... H01H 19/00; H01H 19/08; H01H 19/10; H01H 19/56; H01H 19/58; H01H 1/44;
(Continued)

(56) References Cited

U.S. PATENT DOCUMENTS 2,666,101 A 1/1954 Ellithorpe
3,602,656 A 8/1971 Graddy et al.
(Continued)

FOREIGN PATENT DOCUMENTS

CN Y-2274706 2/1998
CN 1861964 A 11/2006
(Continued)

OTHER PUBLICATIONS

International Search Report dated Aug. 22, 2017 for PCT/JP2017/018385 [English translation].
(Continued)

*Primary Examiner* — Vanessa Girardi
(74) *Attorney, Agent, or Firm* — Faegre Drinker Biddle & Reath LLP

(57) ABSTRACT

A rotary switch device includes a terminal base to which a center portion contact and a fixed contact are fixed, a rotation operation member which is operable to rotate around the center portion contact with respect to the terminal base, a plate-like movable contact member which includes a contact protrusion part and a contact surface and which is held in the rotation operation member so as to short-circuit between the center portion contact and the fixed contact at a conductive rotation position, and a compression coil spring of a barrel type.

4 Claims, 9 Drawing Sheets

(51) Int. Cl.
*H01H 19/02* (2006.01)
*H01H 27/06* (2006.01)

(58) Field of Classification Search
CPC ..... H01H 1/2008; H01H 2231/026; H01H 2235/01; H01H 50/546
See application file for complete search history.

(56) References Cited

U.S. PATENT DOCUMENTS

| | | | | | |
|---|---|---|---|---|---|
| 3,803,370 | A * | 4/1974 | Garcia | H01H 19/58 200/11 J |
| 4,490,588 | A * | 12/1984 | Guenther | H01H 19/11 200/11 DA |
| 4,748,297 | A * | 5/1988 | Sorenson | H01H 19/58 200/11 J |
| 4,803,314 | A * | 2/1989 | Sorenson | H01H 19/58 200/110 |
| 5,679,937 | A | 10/1997 | Iwata | |
| 7,841,088 | B2 * | 11/2010 | Ogura | B60G 15/07 267/180 |
| 2008/0121502 | A1 | 5/2008 | Naganuma et al. | |
| 2009/0172946 | A1 | 7/2009 | Ogura et al. | |
| 2013/0203300 | A1 | 8/2013 | Mori | |
| 2015/0099390 | A1 | 4/2015 | Mori | |
| 2016/0285188 | A1 | 9/2016 | Mori | |

FOREIGN PATENT DOCUMENTS

| | | | | |
|---|---|---|---|---|
| CN | A-101111913 | | 1/2008 | |
| CN | U-204647102 | | 9/2015 | |
| CN | A-105388335 | A | 3/2016 | |
| DE | 8904537 | * | 9/1989 | H01H 19/58 |
| EP | A2-0757366 | | 2/1997 | |
| GB | 1 495 215 | A | 12/1977 | |
| JP | H02-129479 | A | 5/1990 | |
| JP | A-H08-245040 | | 9/1995 | |
| JP | H08-115640 | A | 5/1996 | |
| JP | 2015-103495 | A | 6/2015 | |

OTHER PUBLICATIONS

International Search Report/Written Opinion dated Aug. 22, 2017 for PCT/JP2017/018385 [non-English language].
CN Office Action dated Sep. 29, 2019 in Chinese Application No. 201780030463.4 (with attached English-language translation).
Extended European Search Report issued on Dec. 6, 2019 in corresponding European Patent Application No. 17799388.8.
The Second Office Action dated Jun. 12, 2020 in Chinese Patent Application No. 201780030463.4 (11 pages) with an English translation (15 pages).

* cited by examiner

ROTARY SWITCH DEVICE

CROSS REFERENCE TO RELATED APPLICATIONS

This application is a continuation of PCT application No. PCT/JP17/018385, which was filed on May 16, 2017 based on Japanese Patent Application (No. 2016-099040) filed on May 17, 2016, the contents of which are incorporated herein by reference.

BACKGROUND OF THE INVENTION

Field of the Invention

The present invention relates to a rotary switch device.

Description of Related Art

Patent literature 1 discloses a rotary switch device in which a movable contact member is rotated to be in contact with a fixed contact. In the rotary switch device of patent literature 1, a circular first fixed contact portion is exposed to be disposed at a center portion of a terminal base formed of an insulating material. Second and third fixed contact portions are disposed so as to surround the first fixed contact portion.

The movable contact member (contact plate) is urged to a terminal base side by a contact spring formed of a cylindrical coil spring held by a rotor, and a contact pressure with the fixed contact portion is secured.

[Patent Literature 1] JP-A-2015-103495

In the rotary switch device of patent literature 1, in order to hold the cylindrical coil spring in an upright state without falling down, a cylindrical hole for accommodating the cylindrical coil spring is required. However, an operation of inserting the cylindrical coil spring into the hole is troublesome because a coil center axis of the cylindrical coil spring has to be aligned with a center of the cylindrical hole and then the cylindrical coil spring is inserted. In particular, it is difficult to be inserted by an automatic machine and production efficiency is poor.

SUMMARY

One or more embodiments provide a rotary switch device in which a manufacturing efficiency is improved by improving an insertion operability of a compression coil spring.

According to one or more embodiments, a rotary switch device including a terminal base 3 to which a center portion contact 1 and a fixed contact 2 are fixed, a rotation operation member 4 which is operable to rotate around the center portion contact 1 with respect to the terminal base 3, a plate-like movable contact member 7 which includes a contact protrusion part 5 which is pressed in contact with the center portion contact 1 at one end of one surface of plate thickness surfaces and a contact surface 6 which is in contact with the fixed contact 2 at another end of the one surface of the plate thickness surfaces, and which is held in the rotation operation member 4 so as to short-circuit between the center portion contact 1 and the fixed contact 2 at a conductive rotation position, and a compression coil spring 10 of a barrel type in which one end is supported by a bottom surface 9 of a spring accommodation hole 8 formed in the rotation operation member 4 and another end is pressed in contact with a back surface against the one surface of the plate thickness surfaces forming the contact protrusion part 5 and the contact surface 6 of the movable contact member 7 so as to urge the contact protrusion part 5 and the contact surface 6 to a side of the terminal base 3.

In one or more embodiments, the compression coil spring of the barrel type is used for the compression coil spring 10 that presses the movable contact member 7 to apply a contact pressure with the contact on the terminal base 3 to the movable contact member 7, and is inserted into the spring accommodation hole 8 of the rotation operation member 4. The compression coil spring 10 of the barrel type has an outer shape in which a diameter is contracted at a tip and is gradually enlarged as going to a center portion, so that it is easy to introduce the reduced diameter portion of the tip into the spring accommodation hole 8 when the compression coil spring 10 is mounted on the spring accommodation hole 8, and the gentle outer shape is guided to a predetermined position even when the compression coil spring 10 is introduced in an inclined shape. Therefore, an insertion operation is easy and an insertion operation by an automatic machine is also easy.

According to one or more embodiments, a coil inner diameter at a pressing end of the compression coil spring 10 to the movable contact member 7 may be formed smaller than a plate thickness of the movable contact member 7.

In general, the contact pressure between the contacts pressed by the compression coil springs 10 is uniquely determined by a spring constant determined by the number of turns, a wire diameter, a coil diameter, or the like of the compression coil spring 10, and a deflection amount. However, in a case where the coil diameter of the pressing end to the movable contact member 7 is larger than a dimension of the movable contact member 7 in a width direction, that is, a plate thickness, a wire end of the compression coil spring 10 protrudes from the movable contact member 7.

If the wire end of the compression coil spring 10 protrudes from the movable contact member 7, since an effective number of turns or a free length is decreased as compared to a case where a seat surface is fitted over the movable contact member 7, the spring constant changes and a predetermined contact pressure cannot be obtained. However, whether or not protrusion of the wire end of the movable contact member 7 from the seat surface occurs is determined by a rotation angle around a coil center axis when mounting the compression coil spring 10, and control is impossible, so that it is difficult to ensure a predetermined contact pressure.

Variation in the contact pressure changes a contact resistance between the contacts, so that it causes variation of an output potential and in a case where corrosion of the contact is prevented by applying corrosion resistant plating in the movable contact member 7 or the fixed contact 2 portion, an excessive increase in the contact pressure causes destruction of a corrosion resistant plating film, which in turn leads to an increase in contact resistance due to corrosion of the contact and also causes contact failure.

In one or more embodiments in which the inner diameter of the pressing end abutting against the movable contact member 7 is smaller than the plate thickness of the movable contact member 7, the seat surface of the compression coil spring 10 can abut against the movable contact member 7 without protruding, so that the spring constant does not change depending on a mounted state and a stable contact pressure between the contacts can be provided.

As a result, for example, the corrosion resistant plating is applied to the movable contact member 7 and the fixed contact 2 to ensure conductivity by a low contact pressure, to prevent oxidation of the contact, and to eliminate the sliding contact between the contacts for removing an oxide film. Therefore, even in a case where the rotary switch device can be used in a low current specification, it is possible to reliably prevent peeling of the plating film due to an excessive increase in the contact pressure.

In addition, since the compression coil spring 10 of the barrel type has a coil portion having a diameter larger than that of the diameter-reduced end, an aspect ratio (L/D, where L is a free length and D is a coil average diameter) can be reduced compared to that of a cylindrical coil spring in which both ends are the coil diameter. Therefore, a buckling phenomenon during operation hardly occurs and a spring index (D/d, where d is a wire diameter) can be adjusted to a suitable value to maintain favorable workability.

According to one or more embodiments, the bottom surface may has a circular shape having substantially the same diameter as a coil outer diameter at a supported end of the compression coil spring 10 or a polygonal shape in which the circular shape is inscribed, and a cone-shaped portion 11 which gradually expands along an opening end is formed in a bottom portion 9 of the spring accommodation hole 8.

In general, in the movable contact member 7 which is pressed by a single compression coil spring 10, a rotational moment is generated except in a case where a pressing force acts in a moving direction passing through a center of gravity. Therefore, the contact pressure between the contact protrusion part 5 and the contact corresponding to the contact surface 6 changes depending on a position of an action point.

In addition, even in a case where the contact protrusion part 5 of the movable contact member 7 and a position corresponding to the contact surface 6 are respectively pressed by separate compression coil springs 10, a reaction force from the center portion contact 1 or the fixed contact 2 is determined by a distance between action lines of a pressing force by the compression coil spring 10 and a distance between a reaction force action line from each contact and the action line of the pressing force by the compression coil spring 10. Therefore, if a position of the action line of the compression coil spring 10 is not fixed, it causes variation of the contact pressure at each contact.

In one or more embodiments, the bottom surface 9 of the spring accommodation hole 8 which supports the supported end of the compression coil spring 10 is formed in the circular shape having substantially the same diameter as the coil outer diameter in the supported end of the compression coil spring 10 or in the polygonal shape having the circular shape inscribed therein, and the diameter is gradually expanded or enlarged along the opening end. Therefore, the compression coil spring 10 introduced into the cone-shaped portion 11 is naturally guided to a position at which the coil center axis is preset.

As a result, it is possible to precisely control the support position (base end position) of the compression coil spring 10, so that no deviation of an action point of an urging force to the movable contact member 7 occurs and a stable contact pressure between the contacts can be provided.

In this case, the spring accommodation hole 8 may be formed so as to constrain a maximum coil diameter portion of the compression coil spring 10 and regulate falling of the compression coil spring 10. In this case, since falling of the compression coil spring 10 can be effectively prevented, it is possible to further precisely determine the action position of the plating film to the movable contact member 7.

According to one or more embodiments, a manufacturing efficiency can be improved by improving an insertion operability of the compression coil spring.

DETAILED DESCRIPTION

Figure 1:
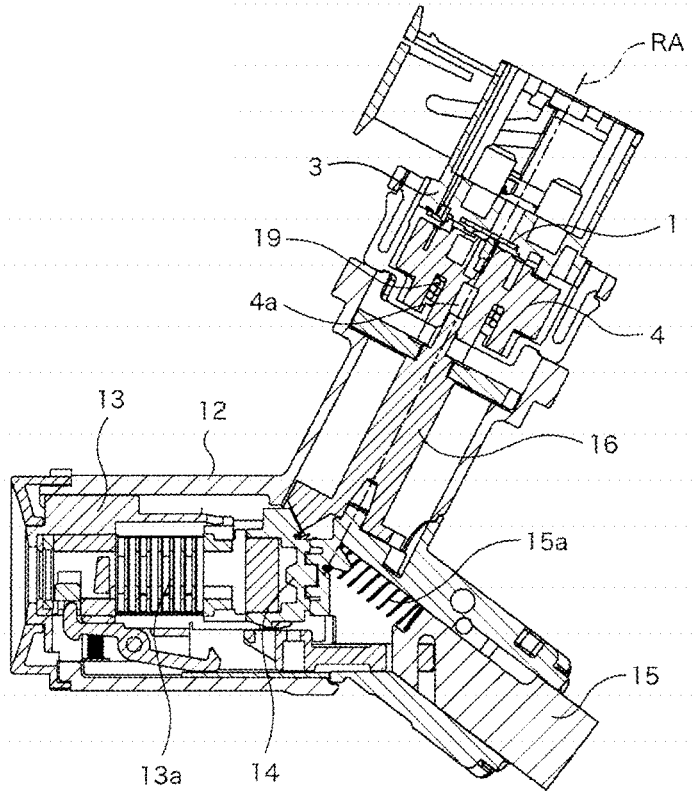
FIG. 1 is a sectional view illustrating a steering lock apparatus.

A rotary switch device of the present invention configured as an ignition switch used in a steering lock apparatus is illustrated in FIG. 1 and the following. The steering lock apparatus of the example includes a cylinder lock 13 accommodated in a housing 12 and a cam member 14 connected to a terminal of a plug 13*a* of the cylinder lock 13, and is fixed to a steering column (not illustrated).

The housing 12 is provided with a lock piece 15 which moves between a lock position which advances and retreats in a direction intersecting a rotation axis of the cam member 14 at a predetermined angle and protrudes into the steering column, and an unlock position which is accommodated in the housing. The lock piece 15 is urged to a direction of the lock position by a compression spring 15*a* and when the plug 13*a* of the cylinder lock 13 is rotatively operated from a lock rotation position, the lock piece 15 moves from the lock position where the lock piece 15 is locked to a steering shaft to the unlock position where the lock piece 15 is released, and the steering shaft can be operated.

In addition, the ignition switch is connected to the housing 12 to cause predetermined terminals to conduct in accordance with the rotation of the plug 13*a* and a power supply state to an electrical system of a vehicle to be changed. In order to transmit the rotational operation of the plug 13*a* to the ignition switch, a connecting bar 16 which meshes with the cam member 14 and rotates together with the cam member 14 is disposed in the housing 12.

Figure 2:
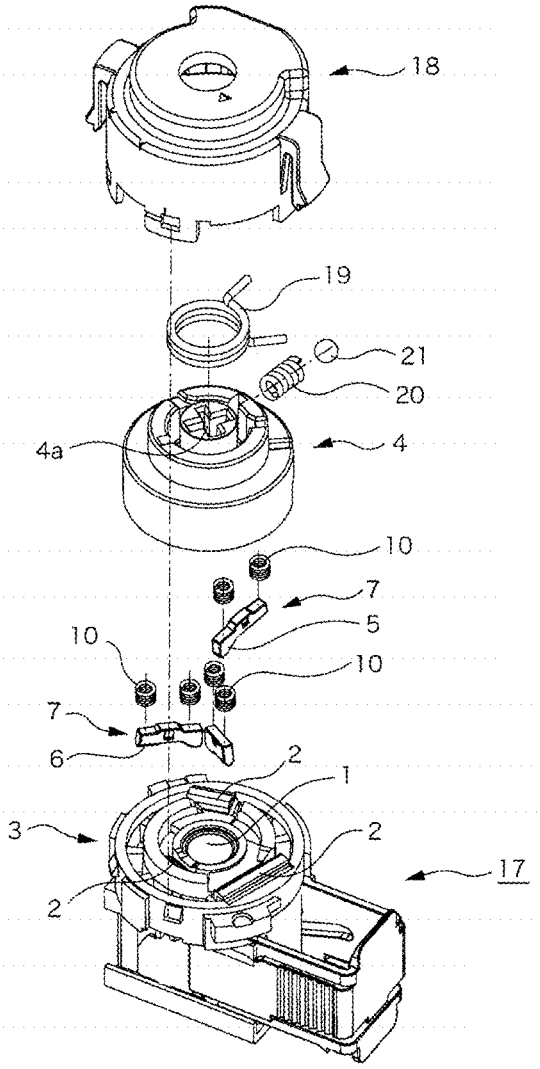
FIG. 2 is an exploded perspective view of an ignition switch.

As illustrated in FIG. 2, the ignition switch includes a switch case 17 having a terminal base 3 having a circular shape in plan view, a rotation operation member 4 rotatable around a center of the terminal base 3 with respect to the switch case 17, and a switch cover 18 connected to the switch case 17 to cover the rotation operation member 4. A center portion contact 1 and a fixed contact 2 are disposed in the terminal base 3 formed by an insulating material in a state of being exposed to a rotation boundary surface with the rotation operation member 4.

The center portion contact 1 and each fixed contact 2 are drawn into the switch case 17 via wiring.

The rotation operation member 4 is formed of an insulating material and the connecting bar 16 and a connecting hole 4*a* are formed at one end portion. The rotation operation member 4 is urged only when returning from a START position (described later) to an ON position by a torsion spring 19, and moderately rotates at an appropriate connecting operation angle by fitting a click ball 21 urged by a click spring 20 into a groove of an inner wall of the switch cover 18.

Figure 7A:
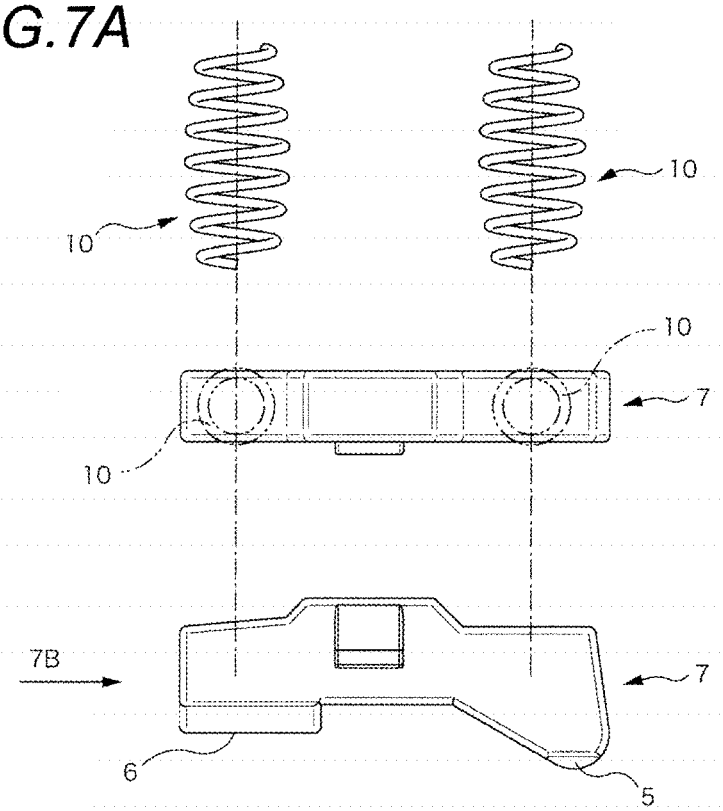
FIG. 7A is a view illustrating the movable contact member and illustrating a positional relationship of the movable contact member and compression coil springs.
Figure 7B:
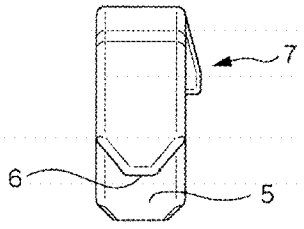
FIG. 7B is a view taken in direction of arrow 7B in FIG. 7A.

Furthermore, in rotation operation member 4, a plate-like movable contact member 7 having a predetermined plate thickness is held toward the terminal base 3. As illustrated in FIGS. 7A and 7B, the movable contact member 7 includes a contact protrusion part 5 that is a V-shaped protrusion at one end and a flat contact surface 6 at the other end of the plate thickness surface, and a rounded chamfer is formed at a tip of the contact protrusion part 5 in order to keep a good contact state when the movable contact member 7 is pressed in contact with the center portion contact 1 which is described later.

Three of the flat movable contact members 7 formed as described above are used to correspond to the respective fixed contacts 2 which are described later. Silver plating as corrosion resistant conductive processing is applied to the surfaces of the movable contact member 7 and each fixed contact 2 in order to prevent occurrence of corrosion on the contact surface and enhance contact reliability without requiring a self-cleaning operation by a high contact pressure.

Each movable contact member 7 is held by the rotation operation member 4, and is movable in a direction along a rotation axis (RA) in FIG. 1, and, as described below, is urged to a surface side of the terminal base 3 by compression coil springs 10 pressing the contact protrusion part 5 and a back surface of the contact surface 6.

Figure 9:
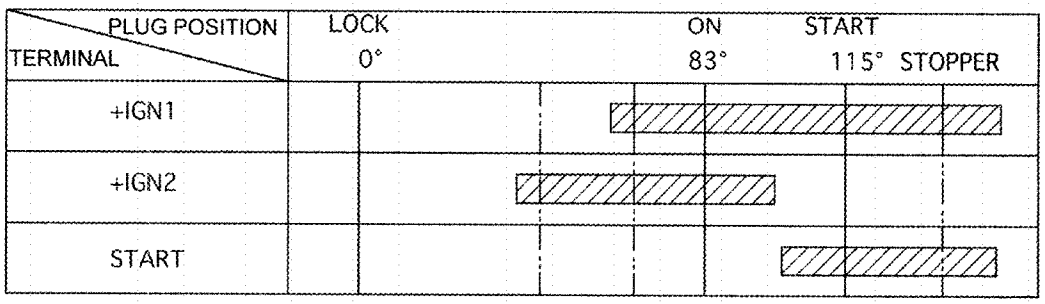
FIG. 9 is a flowchart illustrating a conduction state of a contact of the ignition switch.

The ignition switch according to the example is formed to output a power supply voltage input from a power supply terminal to three output terminals of +IGN1, +IGN2, and START when the plug 13*a* is rotatively operated in the order of LOCK, ON, and START positions. FIG. 9 illustrates a power supply operation to each terminal and power is supplied in the order of the +IGN2 terminal and the +IGN1 terminal by the movement of the plug from the LOCK position to the ON position. Thereafter, when the plug is rotated to the START position, first, the power supply to the +IGN2 terminal is stopped, and then the power supply is started to the START terminal in addition to the +IGN1 terminal where the power supply state is maintained.

The sequence described above is realized by short-circuiting the center portion contact 1 disposed at a center portion of the terminal base 3 and the fixed contact 2 disposed around the center portion contact 1 and connected to the +IGN1 terminal, the +IGN2 terminal, and the START terminal by the movable contact member 7 described above.

Figure 3:
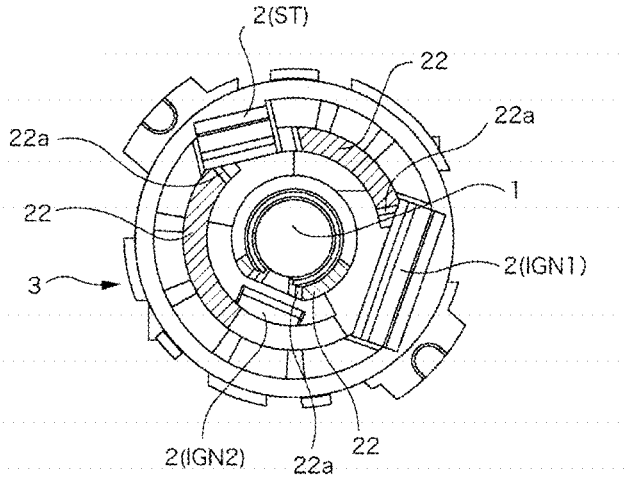
FIG. 3 is a view illustrating an arrangement of fixed contacts.
Figure 5A:
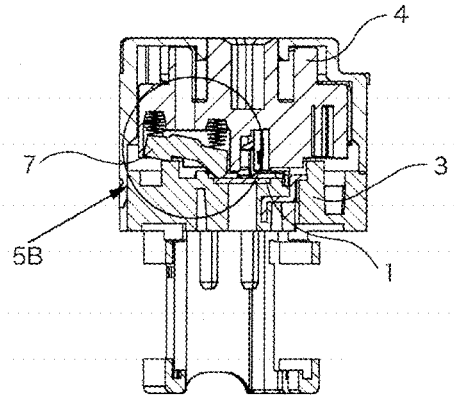
FIG. 5A is a sectional view taken along line 5A-5A of FIG. 4.
Figure 5B:
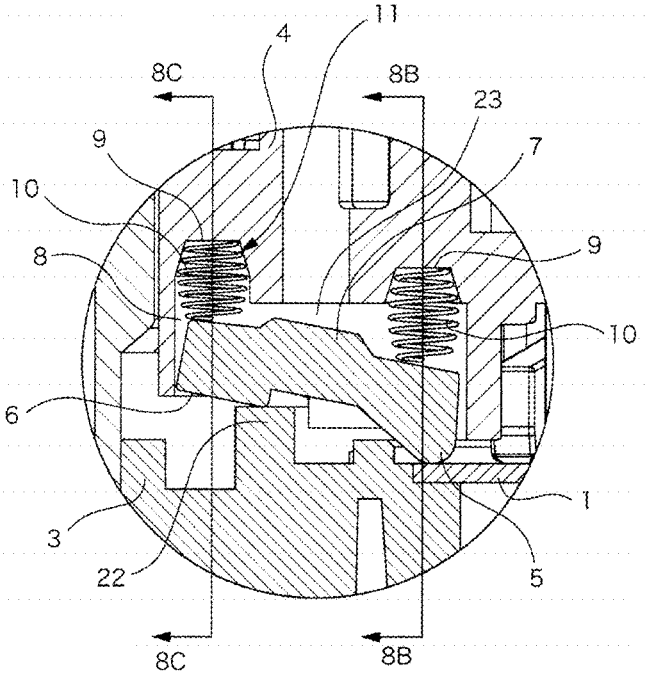
FIG. 5B is an enlarged view of a 5B portion of FIG. 5A.

The three fixed contacts 2 are respectively disposed at terminal positions of three support portions 22 formed in the terminal base 3. Each fixed contact 2 is formed in a rectangular shape intersecting the support portion 22, the support portion 22 is disposed on two concentric circles with respect to the center of the terminal base 3, and as illustrated in FIGS. 5A and 5B, supports a corner portion of the contact surface 6 of the movable contact member 7 in a non-contact state with the fixed contact 2. Moreover, in FIG. 3, the support portion 22 is indicated by hatching.

Figure 6A:
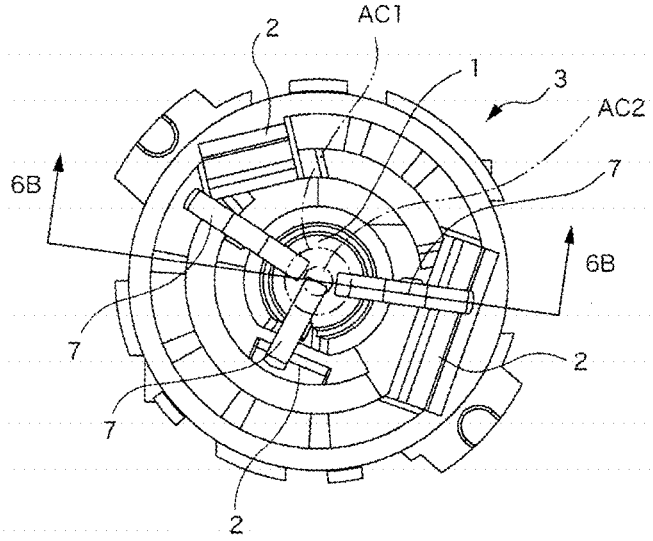
FIG. 6A is a plan view illustrating a position of the movable contact member in an ON position.
Figure 6B:
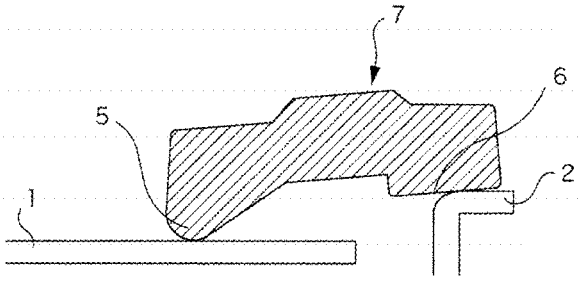
FIG. 6B is a sectional view taken along line 6B-6B of FIG. 6A.

The contact surface 6 of the movable contact member 7 in a riding state on the support portion 22 is held at a position higher than a height of a center contact of the contact surface 6 in a state where the contact surface 6 illustrated in FIG. 6B rides on the fixed contact 2.

As described above, in the non-contact state in which the movable contact member 7 is not in contact with the fixed contact 2, the support portion 22 supports the end opposite to the contact protrusion part 5 of the movable contact member 7 and functions as a traveling path when the movable contact member 7 is horizontally and rotatively operated.

Furthermore, the center portion contact 1, the fixed contact 2, and the support portion 22 are formed in a floating island shape of which a periphery is surrounded by a recessed portion, and propagation of the abrasion powders between the fixed contacts 2, and between the support portion 22 and the fixed contact 2, and coagulated powder of molten splashes due to the arc discharge is regulated.

Figure 4:
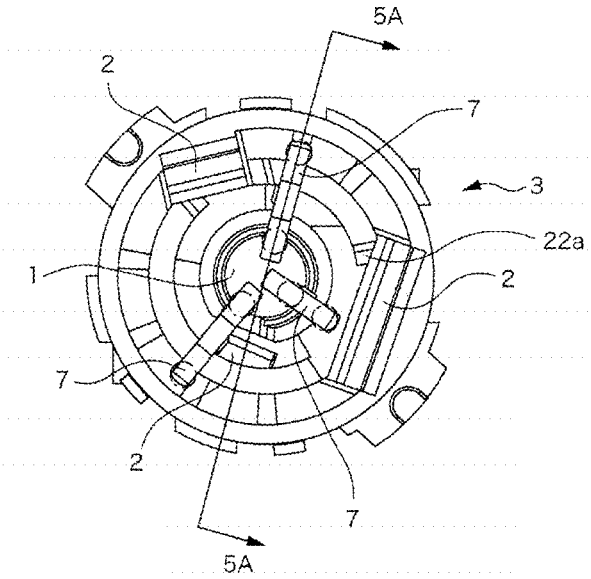
FIG. 4 is a view illustrating a position of a movable contact member at a LOCK position.

When the movable contact member 7 is operated to rotate in the clockwise direction in FIG. 4 from a non-conductive state illustrated in FIGS. 4 to 5B, the movable contact member 7 travels on the support portion 22 with the contact portion of the support portion 22 as the sliding portion, and then rides on an inclined surface 22*a* formed at a terminal of the support portion 22. The inclined surface 22*a* is formed to gradually become a low back, the movable contact member 7 moved to the inclined surface 22*a* vertically rotates to a vicinity of a horizontal posture while reducing a vertical rotation angle, and lands on the fixed contact 2 as illustrated in FIGS. 6A and 6B.

As illustrated in FIG. 7B, the contact surface 6 of the movable contact member 7 is formed in a V shape in front view, so that landing to the fixed contact 2 or movement from the fixed contact 2 to the support portion 22 is smoothly performed.

If sliding loci of the movable contact members 7 in the center portion contact 1 overlap each other, a chance of wear at an overlapping portion increase. In order to prevent this, as illustrated by chain lines in FIG. 6A, the movable contact member 7 that is in contact with and disconnected from the +IGN1 terminal and the movable contact member 7 that is in contact with and disconnected from the +IGN2 terminal of which rotation ranges overlap each other move along arcs (AC1 and AC2) having different diameters on the center portion contact 1.

Figure 8A:
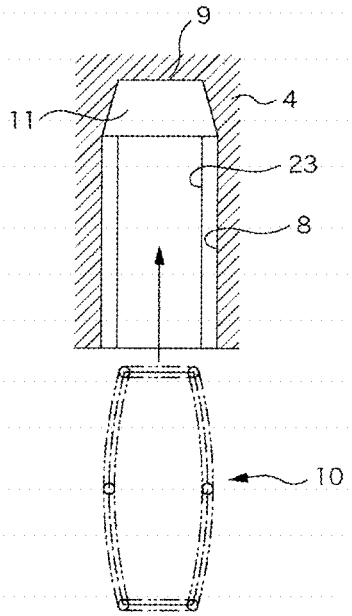
FIG. 8A is a view illustrating a state where the compression coil spring in a free state is inserted into a spring accommodation hole.
Figure 8B:
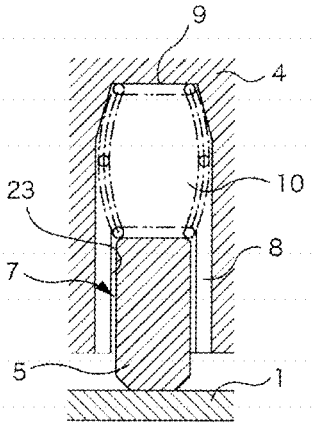
FIG. 8B is a sectional view taken along line 8B-8B of FIG. 5B.
Figure 8C:
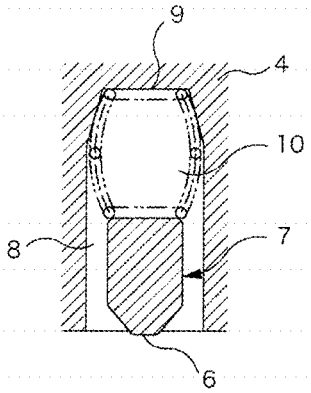
FIG. 8C is a sectional view taken along line 8C-8C of FIG. 5B.

As illustrated in FIGS. 8A to 8C, the movable contact member 7 is fitted into a contact mounting groove 23 formed in the rotation operation member 4. The movable contact members 7 fitted into the contact mounting grooves 23 press the contact protrusion part 5 and a back surface with respect to a plate thickness surface on which the contact surface 6 is formed by the compression coil springs 10 inserted into the spring accommodation holes 8 penetrating the contact mounting grooves 23 to apply the contact pressure with the fixed contact 2 to the movable contact member 7.

As illustrated in FIG. 8A, the compression coil spring 10 is a compression coil spring of a barrel type having a coil diameter is large at a center portion and is gradually reduced as going to both ends, and the coil diameters at the both end are the same so as to be capable of being used in an inverted posture.

A spring constant of the compression coil spring 10 is adjusted to exceed the contact pressure so that a contact resistance value with respect for low current conduction is sufficiently low and to be equal to or less than a contact pressure at which peeling of the plating film during sliding occurs in a pressure contact state with the fixed contact 2 or the center portion contact 1 (the state in FIG. 8B).

In addition, the spring constant of the compression coil spring 10 of the barrel type is nonlinear because the coil diameter is changed, but a flexure region in the vicinity of the center portion having a large coil diameter substantially exhibiting linearity is used.

As illustrated in FIG. 7A, the coil inner diameter at a tip portion of the compression coil spring 10 is formed to be smaller than a plate thickness of the movable contact member 7 and a pressing end with respect to the movable contact member 7 is held without protruding onto the plate thickness surface of the movable contact member 7.

As a result, when the movable contact member 7 is pressed, a factor of changing the spring constant such as a loss of an effective number of turns caused by a wire end of the pressing end protruding from the plate thickness surface of the movable contact is eliminated.

As illustrated in FIGS. 8A to 8C, the cone-shaped portion 11 is formed at the bottom portion of the spring accommodation hole 8 and the end portion (supported end) on the other side of the compression coil spring 10 is supported on the bottom surface 9. The bottom surface 9 is formed in the same circular shape as the supported end of the compression coil spring 10 having a substantially same diameter as the coil outer diameter of the supported end thereof.

In addition, a wall surface of the cone-shaped portion 11 is formed by a conical surface that gradually expands in diameter as going to an opening end, and a diameter of an upper end, that is, the spring accommodation hole 8 is slightly larger than a maximum outer diameter of the compression coil spring 10.

Furthermore, as illustrated in FIG. 8B, a depth of the cone-shaped portion 11 is set to an extend in which a side wall is not in contact with an outer periphery of the compression coil spring 10 when an amount of deflection of the compression coil spring 10 becomes a maximum and the maximum outer diameter and the vicinity region thereof approach the bottom surface 9.

Therefore, in the example, when the compression coil spring 10 is inserted into the spring accommodation hole 8, the compression coil spring 10 is guided by the side wall of the cone-shaped portion 11 and the supported end is guided to the center position of the spring accommodation hole 8 which is set in advance. In this state, since the movement of the maximum diameter portion in a lateral direction is regulated by the side wall of the spring accommodation hole 8, excessive inclination is prevented.

As a result, positions of an abutting portion of the compression coil spring 10 against the movable contact member 7 and the supporting end to the rotation operation member 4 are constant, so that the deflection amount of the compression coil spring 10, that is, a size of the urging force can be precisely controlled.

In the example, the pressing force by the compression coil spring 10 is applied to two positions corresponding to the contact protrusion part 5 and the contact surface 6 of the movable contact member 7, so that when an action position of the urging force by each compression coil spring 10 varies, distribution of the contact pressure between the center portion contact 1 and the fixed contact 2 varies, and on the other hand, there is a possibility to cause peeling of the plating film due to an excessive contact pressure and to cause conduction failure or the like due to an insufficient contact pressure.

On the other hand, in the example, since a load point and a size of load with respect to the movable contact member 7 are constant, it is possible to obtain the contact pressure which is set in advance at the contact.

In addition, in a case where the compression coil spring 10 is inserted into the spring accommodation hole 8, since the coil diameter of the end portion is smaller than the diameter of the spring accommodation hole 8 and the compression coil spring 10 is guided during insertion, the insertion operation is easily performed.

Moreover, in the above description, a case where the bottom surface 9 of the spring accommodation hole 8 is formed in the circular shape is illustrated. Alternately, a polygonal shape circumscribing the coil outer diameter at the supporting end of the compression coil spring 10 is provided, or a rib or the like is protruded at a contact point position between a circumscribed polygonal shape and a coil outer periphery from the bottom surface 9 which is larger than in diameter the coil outer diameter, that is, a vertex position of an inscribed polygonal shape, so that the movement of the supporting end can be regulated by a rib tip.

Figure 10A:
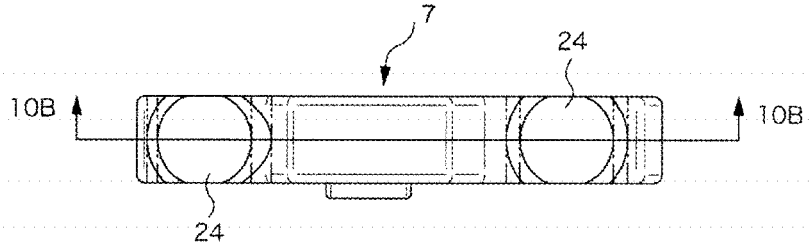
FIG. 10A is a plan view illustrating a modification example of the movable contact member.
Figure 10B:
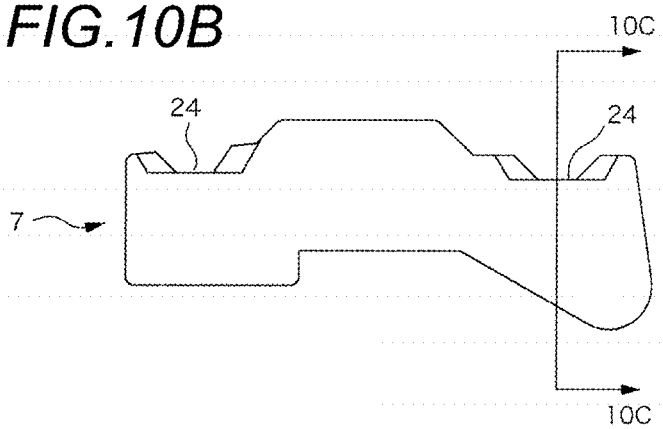
FIG. 10B is a sectional view taken along line 10B-10B of FIG. 10A.
Figure 10C:
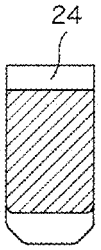
FIG. 10C is a sectional view taken along line 10C-10C of FIG. 10B.

In addition, in the above description, a case where the portion of the movable contact member 7 pressed by the compression coil spring 10 is formed to be a flat surface is illustrated. However, as illustrated in FIGS. 10A to 10C, a fitting recessed portion 24 for the pressing end of the compression coil spring 10 to fit in can also be formed. In this case, in addition to a curved conical surface, the fitting recessed portion 24 can also be a linear inclined surface as illustrated by chain lines in FIG. 10A.

REFERENCE SIGNS LIST

1 center portion contact
2 fixed contact
3 terminal base
4 rotation operation member
5 contact protrusion part
6 contact surface
7 movable contact member
8 spring accommodation hole
9 bottom surface
10 compression coil spring
11 cone-shaped portion

What is claimed is:

1. A rotary switch device comprising:

a terminal base to which a center portion contact and a fixed contact are fixed;

a rotation operation member which is operable to rotate around the center portion contact with respect to the terminal base;

a plate-like movable contact member which includes a contact protrusion part which is pressed in contact with the center portion contact at one end of one surface of plate thickness surfaces and a contact surface which is in contact with the fixed contact at another end of the one surface of the plate thickness surfaces, and which is held in the rotation operation member so as to short-circuit between the center portion contact and the fixed contact at a conductive rotation position; and a compression coil spring of a barrel type corresponding to the contact protrusion part and the contact surface of the movable contact member resulting in an urging force that varies contact pressure between the center portion contact and the fixed contact.

2. The rotary switch device according to claim 1, wherein a coil inner diameter at a pressing end of the compression coil spring to the movable contact member is smaller than a plate thickness of the movable contact member.

3. The rotary switch device according to claim 1, wherein the bottom surface has a circular shape having substantially the same diameter as a coil outer diameter at a supported end of the compression coil spring or a polygonal shape in which the circular shape is inscribed, wherein a cone-shaped portion is formed at a bottom portion of the spring accommodation hole, and the cone-shaped portion is formed in a conical shape that gradually expands from the bottom surface of the spring accommodation hole towards an opening end of the spring accommodation hole.

4. The rotary switch device according to claim 3, wherein the spring accommodation hole is formed so as to constrain a maximum coil diameter portion of the compression coil spring and regulate falling of the compression coil spring.

* * * * *